United States Patent [19]

Grant

[11] Patent Number: 4,598,096

[45] Date of Patent: Jul. 1, 1986

[54] SAFE SENSORY IRRITANT

[76] Inventor: George A. Grant, 46 Crystal Beach, Nepean, Ontario K2H5M9, Canada

[21] Appl. No.: 318,817

[22] Filed: Nov. 6, 1981

[51] Int. Cl.[4] ..... A61K 31/075

[52] U.S. Cl. ..... 514/715; 102/512; 514/890

[58] Field of Search ..... 424/339; 102/512; 514/715, 890

[56] References Cited

U.S. PATENT DOCUMENTS 3,419,274 12/1968 Tabor ..... 102/512

4,249,025 2/1981 Hydro ..... 424/339

*Primary Examiner*—Albert T. Meyers

*Assistant Examiner*—John M. Kilcoyne

*Attorney, Agent, or Firm*—Quaintance, Murphy & Presta

[57] ABSTRACT

A method of safely forcing the egress of human beings from a zone by supplying the zone with an irritating amount of 1-methoxy-1,3,5-cycloheptatriene.

9 Claims, 7 Drawing Figures

SAFE SENSORY IRRITANT

FIELD OF THE INVENTION

This invention relates to the use of 1-methoxy-1,3,5-cycloheptatriene, hereinafter sometimes referred to as "GG", to compositions containing GG, to a method of use of GG and to a dispenser that is especially useful with GG.

BACKGROUND OF THE INVENTION

Sensory irritants which are also known as tear gas compositions are widely used today by military forces and civilian police establishments as riot control agents and to force the egress of human beings from a selected zone. In the past, liquid sensory irritants, such as ethylbromoacetate and chloropicrin, have been used. However, they are no longer used today because they are considered to be too toxic.

All of the commonly employed sensory irritants employed today are solids. Examples of presently employed solid sensory irritants include: 1-chloroacetophenone, commonly referred to as "CN", also available under the trademark MACE; o-chlorobenzlidene malononitrile, commonly known as "CS"; and dibenz (b.f.)-1,4-oxazepine, commonly known as "CR". In order to effectively employ these solid sensory irritants, it is necessary to reduce them to small particles having a diameter of approximately 60 μm. Reduction of the solid sensory irritants to such a small particle size is commonly effected by combining the solid irritant with a pyrotechnic material or delivering the solid sensory irritant in an exploding grenade.

Unfortunately, grenades are hazardous if exploded within approximately twenty feet of personnel owing to the possibility of eye damage from solid fragments. Moreover, when pyrotechnical grenades are employed in enclosed zones, such as in buildings or houses, they can cause extensive property damage by starting fires.

Another disadvantage of the use of presently employed solid sensory irritants is the problem of decontaminating personnel and zones exposed to the solid sensory irritants.

In an attempt to overcome the above problems, the solid sensory irritants have been dissolved in organic solvents to form a solution. This solution has been placed in a shotgun shell or some other type of small munition. Unfortunately, the shell frequently hits a wall or other solid object with the result that the solution drops to the floor, resulting in slow and ineffective dispersal of the sensory irritant or hits a double wall partition causing the solution to remain between the walls.

Decontamination in the case of solid sensory irritants is especially troublesome. A room contaminated with a solid sensory irritant will produce a secondary aerosol from the solid particles remaining in the room. These secondary aerosols effectively prevent the entry into the room of police officers unless they are equipped with gas masks.

A particularly troublesome situation occurs when police desire to confine a suspect who has been exposed to a solid sensory irritant. When placed in the back of a police squad car, the secondary aerosol produced by the solid sensory irritant on the clothes of the suspect can make it impossible for a police officer to drive the squad car without the aid of a gas mask. Furthermore, when a suspect having a solid sensory irritant on his clothes is confined in a jail cell, he and other inmates frequently continue to suffer from the secondary aerosols. While decontamination is possible, it is time-consuming and especially troublesome when large numbers of contaminated suspects have been simultaneously apprehended.

Other sensory irritants have been considered but have been rejected because they cause permanent damage to the eyes and lungs. Other proposed sensory irritants cannot be employed because they are carcinogenic, and/or mutagenic, or cause adverse effects on the blood, liver, kidneys, or internal organs.

Presently employed dispensers for sensory irritants suffer from a large number of disadvantages. When these dispensers are in the form of missiles to be fired into rooms through doors or windows, they frequently miss. In the alternative, when they pass through the door or the window, they can injure the occupants of the room. Most of these dispensers have poor ballistic properties making it difficult to accurately propel them through the air with any accuracy. At the present time, there is no convenient, safe method for disbursing sensory irritants directly through a wall or a door into a room.

Accordingly, it is an object of the present invention to provide an improved sensory irritant, an improved sensory irritant composition and an improved sensory irritant dispenser, all of which are substantially free of one or more of the disadvantages of the prior art.

Another object is to provide an improved sensory irritant that does not have to be employed in the form of a finely-divided solid.

Still another object is to provide an improved sensory irritant that does not require the use of pyrotechnic devices for its dispersal.

Yet another object is to provide an improved sensory irritant that can be easily decontaminated from zones where it is employed and from the clothes of subjects on which it is employed.

Yet another object is to provide an improved sensory irritant that can be rapidly dispersed in its zone of use.

Still another object of the present invention is to provide an improved sensory irritant which is safe; does not cause permanent damage to eyes, nose, throat or lungs; is not carcinogenic; is not mutagenic; and does not adversely affect the blood or internal organs of subjects exposed to it.

Still another object of the present invention is to provide an improved dispenser which can be employed with the sensory irritants of the present invention and with other sensory irritants to directly deliver the sensory irritants into a room through a door or a wall.

The above and other objects of the present invention are accomplished by providing a method for safely forcing the egress of human beings from a zone by supplying the zone with an irritating amount of 1-methoxy-1,3,5-cycloheptatriene.

According to another aspect of the present invention, an improved composition useful as a sensory irritant is provided. The composition comprises 1-methoxy-1,3,5-cycloheptatriene; an anti-oxidant; and a volatile non-aqueous solvent. In this composition, the solvent is present in an amount sufficient to dissolve the 1-methoxy-1,3,5-cycloheptatriene. The anti-oxidant is present in an amount sufficient to prevent the oxidation of the 1-methoxy-1,3,5-cycloheptatriene.

According to yet another aspect of the present invention, a dispenser is provided having a spike that can be employed to penetrate the wall or door into a room and thereby supply the room with 1-methoxy-1,3,5-cycloheptatriene, a composition containing 1-methoxy-1,3,5-cycloheptatriene, or any other liquid sensory irritant.

Figures 1, 2, 3, 4, 5:
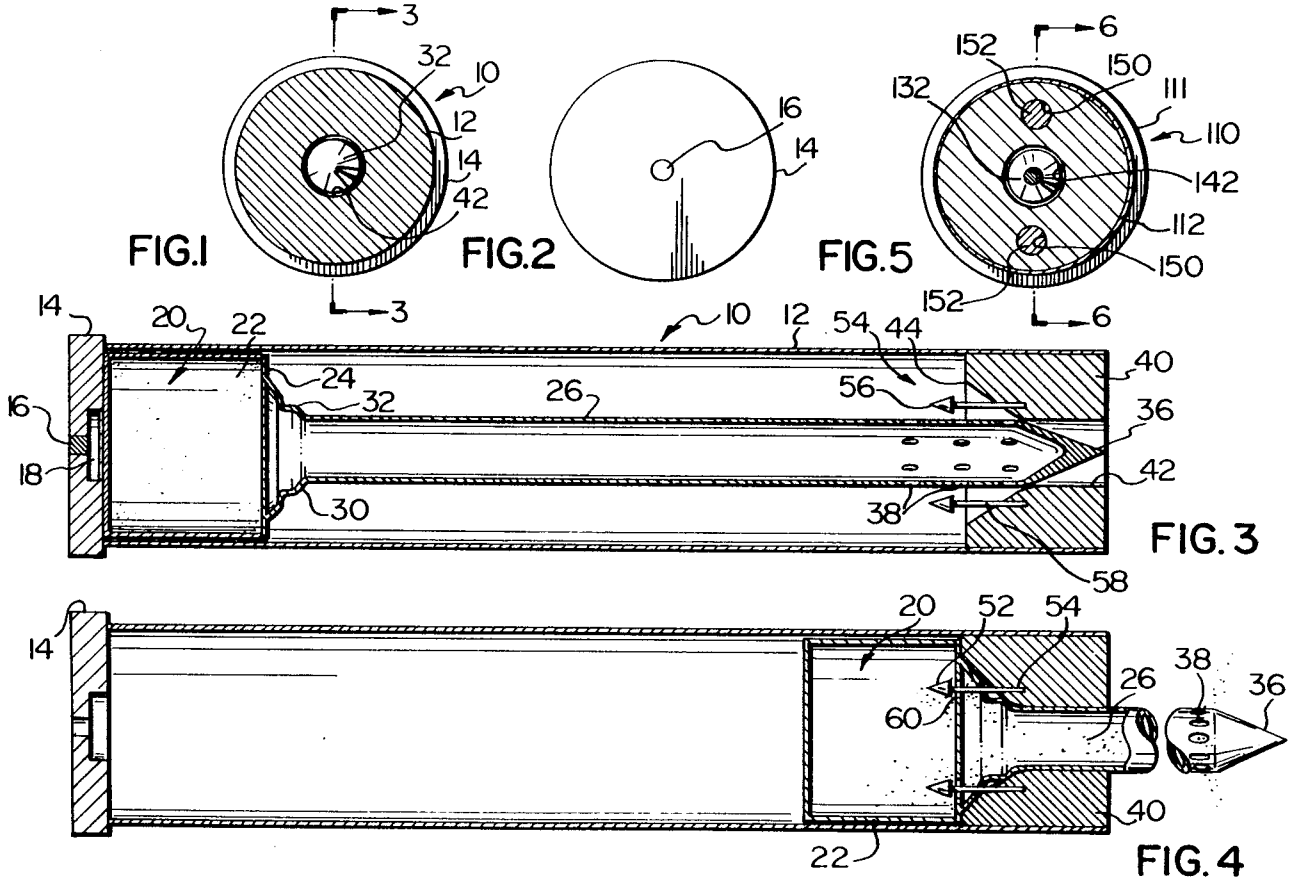
FIG. 1 is a front end view of a tear gas dispensing canister for use in dispensing a sensory irritant into enclosed areas from areas adjacent thereto.
FIG. 2 is a rear end view of the canister of FIG. 1.
FIG. 3 is a cross-sectional view of an embodiment of the tear gas dispensing canister before firing, taken along line 3—3 of FIG. 1.
FIG. 4 is a cross-sectional view of the embodiment of FIG. 3 after firing.
FIG. 5 is a front end view of a modified embodiment of the tear gas dispensing canister.

1-methoxy-1,3,5-cycloheptatriene can be produced from cycloheptatrienyl tetrafluoroborate (I) as described in Conrow K 1963 Organic Synthesis 43, 101. The reaction of (I) with methanol and sodium bicarbonate in water gives 7-methoxy-1,3,5-cycloheptatriene (II), (reference Conrow K1961, J. Am. Chem. Soc. 83,2342). The 1-methoxy-1,3,5-cycloheptriene can be made by the thermal isomerisation of (II) by heating at 150° for 2.5 hours in nitrogen atmosphere in the presence of antioxidants and absence of water, as described by T. NOZOE and K., Takahashi, Bull Chem. Soc. Japan, 38, 665, 1965. Pratt, J. T. Reaction of Cycloheptatriene, PHD Thesis, University of Washington, Seattle, Wash. 1964.

An example of preparation of 7-methoxy-1,3,5-cycloheptatriene follows.

Cycloheptatrienyl tetrafluoroborate 11 gms. (0.66 mole) was dissolved in 60 ml of water and added with rapid stirring to a solution of 4.6 gms. 0.70 mole of sodium methoxide in 300 ml of methanol. The mixture was stirred for 3 hours at room temperature and extracted with ether 4×100 ml portions. The ether extract was washed and dried. The residue was distilled at reduced pressure, to yield 7-methoxy-1,3,5-cycloheptatriene 5.0 gms. b.p. 56°-60°/15 mm.

The 7-methoxy-1,3,5-cycloheptatriene (30 gms) was heated in a pressure flask filled with nitrogen. The pressure vessels were heated for 3 hours at 180°, cooled and contents distilled under vacuum to give a yield of 70% of 1-methoxy-1,3,5-cycloheptatriene b.p. 60°/9 mm.

Further methods of production are described in Columns 1 and 2 and by Example 1 beginning in Column 7 at line 57 of Hydro U.S. Pat. No. 4,249,025, hereinafter referred to as "Hydro". Hydro states that 1-methoxy-1,3,5-cycloheptatriene "... has been known in the art as an effective irritant agent which can be disseminated in the liquid or vapor form by conventional dissemination means ... " (Hydro, Column 13, Line). Neither Hydro nor the present inventors claim to have discovered that 1-methoxy-1,3,5-cycloheptatriene is a sensory irritant. Literally tens of thousands, perhaps even hundreds of thousands, of substances are known to be sensory irritants. Some of the more common include acids, such as acetic acid in vinegar and citric acid in citric fruits, as well as lye from wood ashes and common tobacco smoke. What this inventor has discovered by means of extensive animal and human tests, some of which are disclosed in the examples herein and others of which are continuing, is that 1-methoxy-1,3,5-cycloheptatriene is completely safe and has other desirable properties which allows this sensory irritant to be used by police forces as a riot control agent and as a chemical agent for the removal of barricaded criminals.

Of the scores of tests run employing 1-methoxy-1,3,5-cycloheptatriene, none have given an adverse physiological result.

The zones that can be supplied with 1-methoxy-1,3,5-cycloheptatriene according to the present invention include open-air spaces, as long as the speed of the wind does not exceed the rate at which the 1-methoxy-1,3,5-cycloheptatriene can be supplied to the zone. The zone can also include enclosed and partially enclosed rooms in houses, buildings and other enclosures.

Further, tests have shown that GG and compositions containing GG can be removed below the sensory threshold level from an unfurnished room within the house by ventilation with air. For furnished rooms sprayed with GG, the time is slightly longer but the vapour of GG is not permanently absorbed in materials of the furnishings. Decontaminated buildings or rooms can be safely entered within hours of exposure to the agent.

In the broadest aspects of the present invention, 1-methoxy-1,3,5-cycloheptatriene can be supplied to the zone by any convenient means. However, it is preferably supplied by the improved dispenser described herein.

The 1-methoxy-1,3,5-cycloheptatriene is supplied to the zone in an amount sufficient to force the egress of human beings from the zone. This amount is generally from 1 to 200 mg/m$^3$ and is preferably 5 to 100 mg/m$^3$ of 1-methoxy-1,3,5-cycloheptatriene dispersed in air.

The 1-methoxy-1,3,5-cycloheptatriene can be dispersed as such but it is preferably dispersed in a composition comprising 1-methoxy-1,3,5-cycloheptatriene, an anti-oxidant and a volatile non-aqueous solvent.

The anti-oxidant can be any compound which has a reaction rate with atmospheric oxygen greater than the reaction rate of the 1-methoxy-1,3,5-cycloheptatriene with atmospheric oxygen. Most known anti-oxidants are effective if they are soluble in the solvent employed. Examples of suitable anti-oxidants include among others, Butylated hydroxytoluene (BHT); Butylated hydroxyanisole (BHA); Nordehydroquairetic acid (NDGA); Propylester of 3-4, 5 trihydroxybenzoic acid; thiodipropionic acid; and tocopheral and dilauryl thiopropionate. Butylated hydroytoluene is preferred because of cost availability and reactivity. The anti-oxidant is present in an amount sufficient to prevent the oxidation of 1-methoxy-1,3,5-cycloheptatriene and is generally present in a weight ratio of 1-methoxy-1,3,5-cycloheptatriene to anti-oxidant of 100:0.1 to 100:5 and preferably 100:0.5 to 100:2.

The volatile, non-aqueous solvent can be any solvent in which 1-methoxy-1,3,5-cycloheptatriene is soluble to the desired extent. Examples of suitable solvents include among others chlorinated hydrocarbons, such as 1,1,1-trichloroethane or other freons; straight-chain hydrocarbons; and branched hydrocarbons, such as isopentane. The preferred solvents are those preferably having a boiling point less than 70° C. at atmospheric pressure. An especially preferred solvent is isopentane.

The 1-methoxy-1,3,5-cycloheptatriene can be mixed with the solvent in widely ranging weight ratios from 0.01:100 to 100:100. In spray devices ratios of 0.02:100 to 3:100 have been found useful. In dispensers such as those described herein weight ratios of 1:100 to 30:100 are suitable.

Referring to FIGS. 1–4, there is shown one embodiment of an agent dispenser which could be fired from a 1½ inch gas gun.

The dispenser 10 comprises an outside cylindrical wall or shell 12 adapted to be inserted into a gas gun. The end flange or lip 14 of dispenser 10 provides a fuse cap and has a primer 16 which when appropriately struck by a firing pin (not shown) will set off a charge in main charge chamber 18. Within shell 12 is enclosed tear gas agent chamber 20 in the form of a piston 22 having a forward wall 24. An elongated, hollow cylindrical spike 26 is connected to the forward wall 24 of piston 22, the connection including an enlarged stepped conical portion 30 having a peripheral intermediate shoulder 32. Adjacent the pointed outer end 36 of hollow spike 26 are a plurality of circumferentially spaced orifices 38. Other than stepped conical portion 30 and end 36, spike 26 is generally of uniform diameter.

The end of shell 12 opposite the flange 14 has secured thereof a plug 40 with aperture 42 therein for passage of spike 26. Although the portion of the plug adjacent aperture 42 provides guidance for spike 26, the aperture 42 is of sufficient size to permit the escape of air in the shell forward of piston 22. The inner portion 44 of plug 40 is chambered or tapered to coincide with the conical portion 30 of spike 26. Extending inwardly from the chambered portion 44 of the plug is at least one rigid spear means 54 (two being shown) which has an enlarged head 56 and shaft 58.

The dispersal system shown in FIG. 3 discloses the system prior to the charge in chamber 18 being set off. Shown in FIG. 4 is the location of gas chamber 20 after the main charge has been set off. As will be apparent from FIG. 4, the gas chamber 20 is forced to the right and head 56 of spear means 54 has penetrated the wall of shoulder 32 of conical portion 30 and penetrated the forward wall 24 of gas chamber 20 beneath conical portion 30. Liquid agent under pressure in chamber 20 is forced behind the head 56, around the shaft 58 of the spear means and out the aperture 60 in wall 24 of chamber 20 created by head 56 and into the hollow interior of spike 26. The conical wall portion 30 and inner surface 44 of plug 38 are in sealing association so that the liquid agent is forced only into the spike 26 and out orifices 38 which, in conjunction with the volatility of the liquid, effect atomization of the liquid agent to gas.

Figure 6:
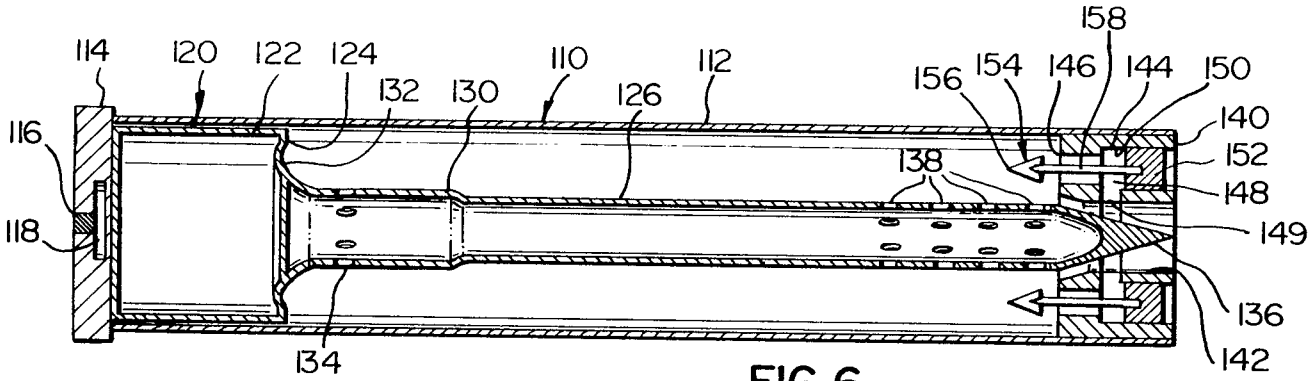
FIG. 6 is a cross-sectional view of the embodiment of FIG. 5 before firing, taken along line 6—6 of FIG. 5.
Figure 7:
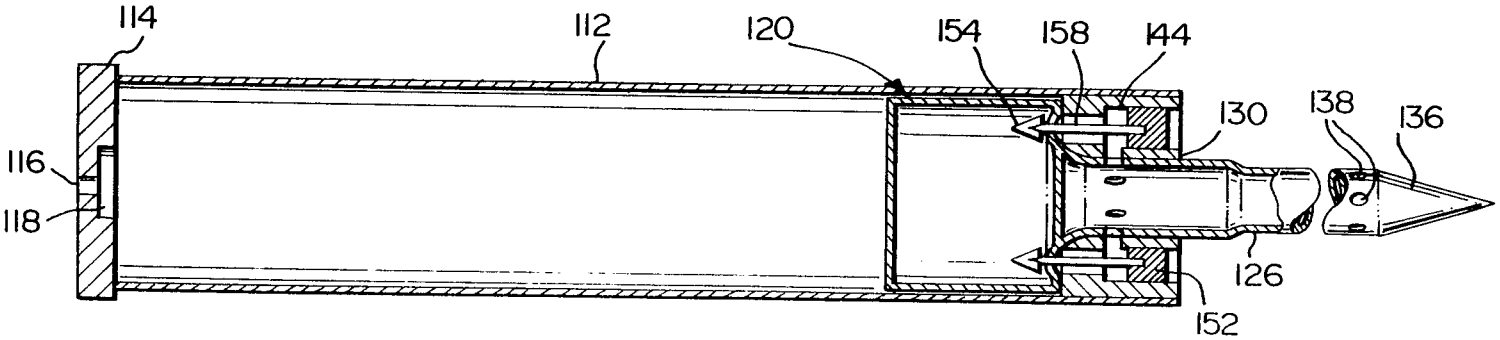
FIG. 7 is a cross-sectional view of the embodiment of FIG. 6 after firing.

FIGS. 5, 6 and 7 show a modified dispersal system 110 which includes shell 112 and flange portion 114 with primer 116 and main charge chamber 118. Agent chamber 120 is in the form of a piston 122 fixedly connected to spike 126. Rather than an enlarged conical portion as shown in the FIG. 3 embodiment, spike 126 has an enlarged slightly tapered portion 130 adjacent piston front wall 124 which wall has peripheral indent 132. The tapered portion 130 has at least one opening 134 therein of predetermined size and location. The end 136 of spike 126 is similar to 36 in FIGS. 3 and 4 and has apertures 138.

The plug 140 in FIG. 6 has a slightly tapered aperture 142, the taper coinciding with the taper on tapered spike portion 130. Plug 140 has at least one passageway 144 (two shown) each having an entrance 146 on the inner face of plug 140 and an exit portion 148 to aperture 142 with inner peripheral channel 149 associated therewith. Chamber 144 has an outer passageway 150 which is closed by plug 152 which can be secured in any appropriate manner including a threaded connection. Protruding from an inner wall of plug 150 and extending toward piston wall 124 through entrance 146 is spear or punch means 154, having head 156 and shaft 158, the purpose of the spear means being to punch a hole in the indent 132 of piston face 124 as the piston is driven toward the plug 140 upon setting off the charge in chamber 118. As the tapered portion 130 comes into sealing relation with plug aperture 142, opening(s) 134 in the spike 126 come into registry with inner peripheral channel 149 and thereby is associated with exit portion 148 of passageway 144.

FIG. 7 shows a further view of the embodiment shown in FIGS. 5 and 6 after firing. When the indent area 132 of wall 124 is punctured, liquid agent being under pressure will be forced behind spear head 156, through entrance portion 146 into exit portion 148 and via peripheral channel 149 through aperture 134 into the interior of spike 126. The liquid agent will then exit from aperture 138, which, in conjunction with the volatility of the liquid agent effects atomization to gas.

With reference to the dispersal systems illustrated in FIGS. 1 to 7, the hollow spike would be about 6" in length and about ⅜ to ½" in diameter. The overall diameter of shell 12 would be such as to permit the dispensing device to be fired from a 1½" gas gun. The spike is constructed of material such as metal and is of sufficient strength to penetrate 2" wooden doors or storm aluminum doors. The agent container 20 would be of sufficient size and strength to carry about 25 ml of an appropriate strength of the agent under gas pressure of 100 PSI and withstand the explosive force necessary to drive the spike through a door or wall.

Although the apertures 42 and 142 are designed to permit the escape of air forward of chambers 20 and 120 before the chamber and spike comes into sealing relationship with plugs 40 or 140, it will be appreciated that openings in the shell adjacent the inner edge of the plugs could also be formed to permit escape of the air forward of the chamber.

The preferred composition of the gas agent for use in such dispersal systems is GG stabilized with approximately 1% anti-oxidant such as butylated hydroytoluene dissolved in a suitable low boiling solvent such as isopentane or Freon 113, and stored under an inert gas such as nitrogen or $CO_2$ at a pressure of 100 PSI.

The invention may be better understood by reference to the following examples which are designed to illustrate the best mode for practicing the present invention. In the following examples, all parts and percentages are by weight unless otherwise indicated.

EXAMPLE 1

This example illustrates the synthesis of a sensory irritant composition of the present invention.

The following quantities of the following ingredients are combined as indicated.

| Item | Ingredient | Quantity(grams) |
|---|---|---|
| A | 1-methoxy-1,3,5-cycloheptatriene | 10 |
| B | butylated hydroxy toluene | 1 |

Item A is a mixture of 98 weight percent of 1-methoxy-1,3,5-cycloheptatriene and 2 weight percent of a mixture of 2-methoxy-1,3,5-cycloheptatriene and 3-methoxy-1,3,5,-cycloheptatriene.

Items A and B are mixed in a closed vessel under a nitrogen blanket to form the mixture of Example 1.

EXAMPLE 2

This example illustrates the synthesis of a composition of the present invention.

The following quantities of the following ingredients are combined as described.

| Item | Ingredient | Quantity(grams) |
|---|---|---|
| A | Mixture of Example 1 | 5 |
| B | Isopentane | 100 |

Items A and B are mixed in a closed vessel under a nitrogen blanket to form a composition especially useful in the present invention as a sensory irritant composition.

EXAMPLES 3–27

These examples illustrate the low tolerance level of human subjects to 1-methoxy-1,3,5-cychloheptatriene.

A human subject, arbitrarily designated as Subject No. 21, wearing a gas mask entered a room having the concentration of 1-methoxy-1,3,5-cycloheptatriene shown in Col. 3 of Table I. The gas mask was equipped with a canister containing a filter and activated charcoal. The subject was instructed to remove the gas mask and remain in the room as long as possible. The subject did so. The time from the removal of the gas mask until his forced egress was 39 seconds or 0.65 minutes. This time was noted and was recorded in Col. 4 of Table I.

The above procedure was repeated with a total of 25 subjects arbitrarily given the numbers recorded in Col. 2 of Table I and the exposure times until egress in minutes recorded in Col. 4 of Table I.

Subjects 47, 51 and 66 remained in the room for the indicated times but became non-functional after 40 seconds in the case of Subject No. 47 and 46 seconds in the case of Subject No. 51. By non-functional, it is meant that the subjects could not recognize typed four-letter words according to the standard Texas Word Recognition Test.

These examples show that 21 out of 25 subjects or 81 percent of subjects exposed to 1-methoxy-1,3,5-cycloheptatriene at the indicated levels are forced to leave the room within one minute and that 23 out of 25 subjects or 92 percent are forced to leave within two minutes. All subjects become non-functional within one minute.

TABLE I

| | EFFECT OF GG | | |
|---|---|---|---|
| 1 EXAMPLE NUMBER | 2 SUBJECT NUMBER | 3 CONCENTRATION (MG—M$^{-3}$) | 4 EXPOSURE (min.) |
| 3 | 21. | 18.5 | 0.65 |
| 4 | 22. | 18.5 | 0.93 |
| 5 | 23. | 18.5 | 1.5 |
| 6 | 24. | 18.5 | 0.78 |
| 7 | 25. | 18.5 | 1.85 |
| 8 | 26. | 18.5 | 0.67 |
| 9 | 47. | 20 | 2.48(1) |
| 10 | 50. | 20 | 0.7 |
| 11 | 51. | 20 | 2.23(2) |
| 12 | 52. | 18.5 | 0.77 |
| 13 | 53. | 18.5 | 0.68 |
| 14 | 54. | 18.5 | 0.75 |

TABLE I-continued

| | EFFECT OF GG | | |
|---|---|---|---|
| 1 EXAMPLE NUMBER | 2 SUBJECT NUMBER | 3 CONCENTRATION (MG—M$^{-3}$) | 4 EXPOSURE (min.) |
| 15 | 55. | 18.5 | 0.72 |
| 16 | 56. | 18.5 | 0.55 |
| 17 | 57. | 18.5 | 0.73 |
| 18 | 58. | 18.5 | 0.65 |
| 19 | 59. | 18.5 | 0.70 |
| 20 | 60. | 18.5 | 0.77 |
| 21 | 61. | 20 | 0.7–0.75 |
| 22 | 62. | 20 | 0.73–0.77 |
| 23 | 63. | 20 | 0.7–0.75 |
| 24 | 64. | 20 | 0.7–0.75 |
| 25 | 65. | 20 | 0.63–0.83 |
| 26 | 66. | 20 | 1.75–2.13 |
| 27 | 67. | 20 | 0.58–1.03 |

Notes:
(1)Subject becomes non-functional after 40 seconds.
(2)Subject becomes non-functional after 46 seconds.

EXAMPLE 28

The procedure of Examples 3–27 were repeated except that the concentration of 1-methoxy-1,3,5-cycloheptatriene was maintained between 10.8 and 12.0 mg/m$^3$. Twenty-nine separate human subjects were exposed. Twenty-one of the subjects exposed were forced to leave within one minute, and all subjects were forced to leave within three minutes.

EXAMPLE 29

This example illustrates the potent effect of 1-methoxy-1,3,5-cycloheptatriene on subjects wearing a gas mask.

Two subjects were exposed to a zone in which the concentration of 1-methoxy-1,3,5-cycloheptatriene was at a level of 100 mg/m$^3$ while the subjects were wearing street clothes and gas masks. After 15 minutes, both subjects reported a strong burning sensation under the arms, in the crotch and in other sweaty areas of the body. Both subjects were forced to leave the zone within 20 minutes.

When the subjects were exposed to fresh air, the GG dispatched from the clothing within minutes and the skin condition abated within 20 minutes. Any slight reddening of the skin occurring abated within one hour.

EXAMPLE 30(a)

This example illustrates the ease of decontamination when employing 1-methoxy-1,3,5-cycloheptatriene.

A room having dimensions of approximately 10′×10′×10′ is supplied with a GG vapor having a concentration of 1-methoxy-1,3,5-cycloheptatriene of approximately 50 mg/m$^3$. The room is opened and ventilated for approximately 20 minutes. It is estimated that the total volume of air exchanged in the room is approximately equal to five times the volume of the room. After the period of ventilation, there is no appreciable residual amount of 1-methoxy-1,3,5-cycloheptatriene in the room or the contents including curtains, rugs and furniture. There is absolutely no evidence of any secondary aerosols.

When GG liquid was sprayed directly on some of the contents of the room, no appreciable residual amount of 1-methoxy-1,3,5-cycloheptatriene existed after a period of ventilation of about 18 to 24 hours.

EXAMPLE 30(b)

The operational concentration for GG will be approximately 20 $mg/m^{-3}$. A room with a volume of 21 $m^3$, containing rugs, drapes, bedding and cushions was contaminated with vapor of GG at a concentration of 129 $mg/m^3$. By passing air flow of 200 cubic feet per minutes for 60 minutes reduced the vapor concentration to 3.5 $mg/m^{-3}$, and after 160 minutes the room was entered and no sensory effects were noted.

EXAMPLE 30(c)

3 ml of liquid agent was put on household effects, drapes, cushions, foam rubber and floor by means of a syringe. The room temperature was 16° C. The room was ventilated for 400 minutes with air flow of 90 to 200 cu. feet per minute. The vapor concentration of the room was decreased to less than 1 $mg/m^3$ and a sensory irritant effect was still detectable. After a further 30 minutes of ventilation, no irritation effects were felt by personnel entering the room. The room was sealed for 16 hours and then ventilated for 35 minutes. Two personnel entered the room and remained in the room for two hours, and felt no irritant effects even after shaking the curtains and other household effects and holding them close to the face for up to 10 minutes. The results of this experiment demonstrates that GG can be removed from household effects within twenty-four hours, even when they are contaminated with liquid agent.

EXAMPLE 31

This example shows the absence of adverse effect of human urine and blood components of human subjects exposed to the mixture of Example 1.

A subject was placed in a room and exposed to the mixture of Example 1 at a level of 0.55 $mg/m^3$ of 1-methoxy-1,3,5-cycloheptatriene in the air for 120 minutes. The subject then leaves the room for two hours; reenters the room and is exposed to 1-methoxy-1,3,5-cycloheptatriene at a level of 0.82 $mg/m^3$ for eight minutes. Twenty-four hours later, the urine and blood of the subject is analyzed and the results recorded for urine in Columns 3 and 4 of Table II, and recorded for blood in Columns 3 and 4 of Tables III and IV relating to Biochemistry and Hemotology respectively.

As is shown in Columns 3 and 4 of Tables II, III and IV, all values are within the normal range. This indicates that 1-methoxy-1,3,5-cycloheptatriene has no adverse effect on human urine or blood constituents.

TABLE II

GG EFFECT ON URINE

| 1 Constituents | 2 Control *D. 17/9/80 | 3 Post Exposure (A) *D. 10/10/80 | 4 Post Exposure (B) *D. 17/10/80 |
|---|---|---|---|
| Routine | yellow clear | yellow clear | yellow clear |
| Blood | neg | neg | neg |
| Bilirubin | neg | neg | neg |
| Ketones | neg | neg | neg |
| Glucose | neg | neg | neg |
| Protein | neg | neg | neg |
| pH. | 6.0 | 6 | 8.5 |
| Specific Gravity | 1.024 | 1.025 | 1.015 |
| Microscopic/HpF | not tested | | |
| RBC (Red Blood Cells) | neg | neg | neg |
| WBC (White Blood Cells) | 4–6 | neg | neg |
| Mucous | moderate | neg | neg |
| Bacteria | trace | trace | neg |
| Epith Cells | rare | neg | rare |
| Crystall | neg | neg | neg |
| Casts/LPF | None | None | neg |
| Others | None | None | neg |

(A) 24 After Exposure To 0.55 $mg/m^3$ for 120 minutes and 0.82 $mg/m^3$ for 8 minutes.

(B) 24 After Exposure To 1.65 $mg/m^3$ for 4.3 minutes and 2.8 $mg/m^3$ for 1.6 minutes.

*Date day/month/year

TABLE III

GG Effect on Biochemistry

| | 1 Control *D. 17/9/80 | 2 Post Exposure (A) *D. 10/10/80 | 3 Post Exposure (B) *D. 17/10/80 |
|---|---|---|---|
| Calcium (8.5–10.5 mg $ldl^{-1}$) | 9.0 | 9.3 | 9.1 |
| Bilirubin Total (0.6–1.7 $mgdl^{-1}$) | 1.3 | 0.6 | 1.2 |
| Bilirubin Direct (0.1–0.3 $mgdl^{-1}$) | 0.35 | 0.20 | 0.20 |
| Cholestrol (120–310 $mgdl^{-1}$) | 216 | 207 | 193 |
| Triglycerides (40–160 $mgdl^{-1}$) | 97 | 77 | 77 |
| Uric Acid (3.4–7.6 $mgdl^{-1}$) | 5.9 | 5.8 | 5.4 |
| CLDH (109–193 I.U.) | 117 | 111 | 95 |
| Alkaline Phosphatase (36–92 I.U.) | 56 | 62 | 57 |
| SGOT (10–30 I.U.) | 26 | 28 | 23 |
| SGPT (6–37 I.U.) | 23 | 18 | 15 |
| Creatinine (0.6–1.4 $mgdl^{-1}$) | 1.0 | 0.6 | 0.4 |
| Bun (7–23 $mgdl^{-1}$) | 19 | 16.5 | 14.5 |
| Glucose Fasting (65–105 $mgdl^{-1}$) | 104 | 99 | 92 |
| Glucose Random hrs. P.C. | | not tested | |
| Sodium (137–146 $mEQl^{-1}$) | 139 | 140 | 142 |
| Potassium (3.5–5.0 $mEQl^{-1}$) | 4.4 | 4.5 | 4.1 |
| Chloride (98–106 $mEQl^{-1}$) | 9.4 | 9.9 | 9.6 |
| Magnesium (1.2–2.0 $mEQl^{-1}$) | 1.4 | 1.6 | 1.7 |
| $CO_2$ Total (21–29 $mEQl^{-1}$) | 27.5 | 28 | 24.0 |
| Total Protein | 7.4 | 7.0 | 7.1 |
| Albumin (3.4–5.3 $gdl^{-1}$) | 5.2 | 4.6 | 5.0 |
| G/G Ratio | 2.4 | 1.8 | 2.4 |

24 hours after exposure to 0.55 $mg/m^3$ for 120 minutes and 0.82 $mg/m^3$ for 8 minutes.

24 hours after exposure to 1.65 $mg/m^3$ for 4.3 minutes and 2.8 $mg/m^3$ for 1.6 minutes.

TABLE III-continued

GG Effect on Biochemistry

*Date: day/month/year

TABLE IV

GG Effect on Hematology

| | 2 Control *17/9/80 | 3 Post Exposure (A) *10/10/80 | 4 Post Exposure (B) *17/10/80 |
|---|---|---|---|
| Hgb (14-18) | 15.4 | 15.5 | 14.4 |
| Hct (40-54) | 44 | 44 | 41.0 |
| W.B.C. (4-10 × $10^3$ $mm^{-3}$) | 6300 | 5200 | 5900 |
| R.B.C. (4-6 × $10^6$ $mm^{-3}$) | 4.81 | 4.79 | 4.55 |
| ESR (0-10) $mmhr^{-1}$ | 4 | 3 | 3 |
| Differentials | | | |
| Poly (50-70%) | 67 | 62 | 68 |
| Lymphs (25-45%) | 26 | 30 | 20 |
| Mono (3-8%) | 3 | 6 | 6 |
| Eosino (1-4%) | 4 | 2 | 6 |
| Baso (0-1%) | not tested | | |
| Stab (3-5%) | not tested | | |

(A) 24 Hours after exposure to 0.55 $mg/m^3$ for 120 minutes and 0.82 $mg/m^3$ for 8 minutes.
(B) 24 Hours after exposure to 1.65 $mg/m^3$ for 4.3 minutes and 2.8 $mg/m^3$ for 1.6 minutes.

*Date: day/month/year

EXAMPLE 32

This example shows the inability of 1-methoxy-1,3,5-cycloheptatriene to induce sister chromatid exchange in cultured human lymphocytes.

Human lymphocytes were treated with 1-methoxy-1,3,5-cycloheptatriene according to the usual procedure. At concentrations of 1-methoxy-1,3,5-cycloheptatriene, less than 50 ml/ml, there was no significant sister chromatid exchange. This means that at a concentration less than 50 ml/ml, 1-methoxy-1,3,5-cycloheptatriene is non-carcinogenic to human lymphocytes. These test results are summarized in Table V.

TABLE V

SISTER CHROMATID EXCHANGE IN HUMAN BLOOD LYMPHOCYTES

| Treatment | Number of Chromosomes | Number of SCEs | SCEs/ Chromosome | SCEs/Cell ± S.E. [46 Chromosomes] |
|---|---|---|---|---|
| Compound: Stabilized GG | | | | |
| Controls Negative: Medium | 2296 | 570 | 0.25 | 11.4 ± 0.5 |
| Solvent: Dimethyl-sulfoxide 1% | 2296 | 543 | 0.24 | 10.9 ± 0.5 |
| Positive: Ethylmethane-sulfonate 0.1 μl/ml | 2285 | 1829 | 0.80 | 36.8** ± 0.9 |
| Stabilized GG | | | | |
| 0.1 nl/ml | 2285 | 485 | 0.21 | 9.8 ± 0.4 |
| 0.5 nl/ml | 2260 | 518 | 0.23 | 10.5 ± 0.5 |
| 1.0 nl/ml | 2280 | 476 | 0.21 | 9.6 ± 0.4 |
| 5.0 nl/ml | 2287 | 598 | 0.26 | 12.0 ± 0.5 |
| 10.0 nl/ml | 2255 | 432 | 0.19 | 8.8 ± 0.4 |
| 50.0 nl/ml | 2285 | 695 | 0.30 | 14.0** ± 0.5 |
| 100.0 nl/ml | 2307 | 783 | 0.34 | 15.6** ± 0.6 |
| 500.0 nl/ml | | TOXIC-No Metaphases | | |

**Significantly greater than solvent control, $p < 0.001$

EXAMPLE 33

This example illustrates the absence of a mutagenic effect when isolated human cells are exposed to 1-methoxy-1,3,5-cycloheptatriene.

Isolated human cells reported in the literature as WI-38 are exposed to various concentrations of 1-methoxy-1,3,5-cycloheptatriene by the procedures described by H. S. Stich et al "DNA Repair and Chemical Carcinogens", Vol. 3, Pages 341-346 of the *Pathology Annual* for 1973. The tests are conducted with activation and without activation by induced rat liver preparation.

The results are shown in Table VI.

These test results show that 1-methoxy-1,3,5-cycloheptatriene is not mutagenic according to the test because disintegration is permitted and therefore incorporation of radioactive thymidine did not increase with the increasing concentration. Unscheduled DNA synthesis did not occur over the range of concentrations tested.

EXAMPLE 34

This example illustrates the absence of a mutagenic effect when 1-methoxy-1,3,5-cycloheptatriene was subjected to various tests.

1-methoxy-1,3,5-cycloheptatriene has been tested in the following assays; with and without metabolic activation; Ames Test, forward and reverse mutation assay in yeast, in human lymocytes; rat dominant lethal assay and mouse micronucleus bone marrow assay. The results were all negative. 1-methoxy-1,3,5,-cycloheptatriene did not demonstrate genetic activity in any of the assays conducted in this evaluation. Therefore 1-methoxy-1,3,5-cycloheptatriene can be considered not mutagenic and not a potent inducer of S.C.E. Rat dominant lethal studies have been done to determine if 1-methoxy-1,3,5-cycloheptatriene is a teratogenic. The results were negative.

TABLE VI

UNSCHEDULED DNA SYNTHESIS IN HUMAN WI-38 CELLS ASSAY

| COMPOUND ACTIVATION SYSTEM: TEST | Stabilized G.G. Induced Rat Liver S9, Lot CG 133 CONCENTRATION | μg DNA | DPM/μg DNA | SOLVENT DMSO PERCENT OF CONTROL |
|---|---|---|---|---|
| NONACTIVATION: | | | | |
| Solvent Control | 1% DMSO | 36.7 | 66.9 | 100.0% |
| Positive Control (MNNG) | 10 μg/ml | 36.0 | 452.7 | 676.7% |
| Test Compound: | | | | |
| GG | 7.8 nl/ml | 31.1 | 58.3 | 87.1% |
| | 15.6 nl/ml | 33.6 | 50.5 | 75.5% |
| | 31.3 nl/ml | 28.3 | 56.1 | 83.9% |
| | 62.5 nl/ml | 28.1 | 45.7 | 68.3% |
| | 125.0 nl/ml | 32.5 | 44.5 | 66.5% |
| | 250.0 nl/ml | 24.0 | 58.2 | 87.0% |
| | 1000.0 nl/ml | 20.7 | 32.9 | 49.2% |
| ACTIVATION: | | | | |
| Solvent Control | 1% DMSO | 45.7 | 27.2 | 100.0% |
| Positive Controls: | | | | |
| B & P | 10 μg/ml | 35.1 | 53.0 | 194.9% |
| DMBA | 25 μg/ml | 38.7 | 42.8 | 157.4% |
| Test Compound: | | | | |
| GG | 7.8 nl/ml | 38.4 | 40.9 | 150.4% |
| | 15.6 nl/ml | 37.5 | 41.0 | 150.7% |
| | 31.3 nl/ml | 39.8 | 32.9 | 121.0% |
| | 62.5 nl/ml | 31.4 | 37.0 | 136.0% |
| | 125.0 nl/ml | 37.1 | 33.4 | 122.8% |
| | 250.0 nl/ml | 39.5 | 43.8 | 161.0% |
| | 500.0 nl/ml | 39.7 | 21.8 | 80.1% |
| | 1000.0 nl/ml | 37.5 | 12.7 | 46.7% |

MNNG = N—methyl-N—nitro-N—nitrosoguanidine
B & P = Benz (a)pyrene
DMBA = Dimethylbenzanthracene
10.9 Ltrs = n/ = Randolitres
DPM = Disintegration per minutes

What is claimed is:

1. A method of safely forcing the egress of human beings from a zone by supplying the zone with an irritating amount of 1-methoxy-1,3,5-cycloheptatriene.

2. The method of claim 1 wherein the zone is a closed room.

3. The method of claim 1 wherein the irritating amount is 1 to 200 mg/m$^3$.

4. The method of claim 1 wherein the irritating amount is 5 to 100 mg/m$^3$.

5. A method of safely forcing the egress of human beings from a room without injuring the human beings and without the danger of creating a secondary aerosol, said process comprising the steps of:

I. inserting a hollow spike into the room; and

II. supplying 1-methoxy-1,3,5-cycloheptatriene through the hollow spike into the room until the concentration reaches an irritating amount; and III. thereby forcing the egress of the human beings from the room.

6. A composition useful as a safe sensory irritant comprising:

A. 1-methoxy-1,3,5-cycloheptatriene; and

B. an anti-oxidant; and

C. a volatile, non-aqueous solvent;

wherein the solvent is present in an amount sufficient to dissolve the 1-methoxy-1,3,5-cycloheptatriene;

wherein the anti-oxidant is present in an amount sufficient to inhibit the oxidation of the 1-methoxy-1,3,5-cycloheptatriene; and wherein the ratio of A:B is 100:0.1 to 100:5.

7. A composition useful as a safe sensory irritant comprising:

A. 1-methoxy-1,3,5-cycloheptatriene; and

B. an anti-oxidant; and

C. a volatile, non-aqueous solvent;

wherein the solvent is present in an amount sufficient to dissolve the 1-methoxy-1,3,5-cycloheptatriene;

wherein the anti-oxidant is present in an amount sufficient to inhibit the oxidation of the 1-methoxy-1,3,5-cycloheptatriene; and wherein the weight ratio of A:C is 0.01:100 to 100:100.

8. A composition of matter useful as a safe sensory irritant that can be contacted with human beings without permanently adversely affecting their eyes or lungs, and without any permanent damage to blood, or kidneys, and without any adverse mutagenic effect; said composition consisting essentially of A. 1-methoxy-1,3,5-cycloheptatriene; and B. butylated hydroxy toluene; and C. isopentane;

wherein the weight ratio of A:B is 100:0.1 to 100:5, and wherein the weight ratio of A:C is 0.01:100 to 100:100.

9. A composition useful as a safe sensory irritant comprising:

A. 1-methoxy-1,3,5-cycloheptatriene;

B. an anti-oxidant; and

C. a volatile, non-aqueous solvent;

wherein the weight ratio of A:B is 100:0.1 to 100:5; and wherein the weight ratio of A:C is 0.01:100 to 100:100.

* * * * *